US010018040B2

(12) United States Patent
Mostowfi et al.

(10) Patent No.: US 10,018,040 B2
(45) Date of Patent: Jul. 10, 2018

(54) SYSTEM AND METHODOLOGY FOR CHEMICAL CONSTITUENT SENSING AND ANALYSIS

(71) Applicant: Schlumberger Technology Corporation, Sugar Land, TX (US)

(72) Inventors: Farshid Mostowfi, Edmonton (CA); Ronald E. G. van Hal, Belmont, MA (US); Shahnawaz Hossain Molla, Edmonton (CA); Jane T. Lam, Randolph, MA (US); Amy Du, Columbus, OH (US); Neil William Bostrom, Salt Lake City, UT (US); Michael Mallari Toribio, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/922,182

(22) Filed: Oct. 25, 2015

(65) Prior Publication Data

US 2016/0115787 A1 Apr. 28, 2016

Related U.S. Application Data

(60) Provisional application No. 62/067,983, filed on Oct. 24, 2014.

(51) Int. Cl.

| | |
|---|---|
| ***E21B 49/08*** | (2006.01) |
| ***B01L 3/00*** | (2006.01) |
| ***B01F 13/00*** | (2006.01) |

(52) U.S. Cl.

CPC ..... *E21B 49/081* (2013.01); *B01F 13/0072* (2013.01); *B01L 3/502784* (2013.01);

(Continued)

(58) Field of Classification Search

CPC ..... B01F 13/0072; B01L 3/502784

See application file for complete search history.

(56) References Cited

U.S. PATENT DOCUMENTS

| | | | |
|---|---|---|---|
| 6,939,717 | B2 | 9/2005 | Jiang et al. |
| 7,707,878 | B2 | 5/2010 | Kanayama et al. |

(Continued)

FOREIGN PATENT DOCUMENTS

| | | |
|---|---|---|
| EP | 2137526 | 4/2009 |
| WO | 2007034131 | 3/2007 |
| WO | WO 2012107799 A1 * | 8/2012 |

OTHER PUBLICATIONS

N. Shao, et al., "Mass transfer during Taylor flow in microchannels with and without chemical reaction," Chemical Engineering, Journal, 2010, 160(3), pp. 873-881.

H.J. Su, et al., "Mass transfer characteristics of H2S absorption from gaseous mixture into methyldiethanolamine solution in a T-junction microchammel," Separation and Purification Technology, 2010, 72(3), pp. 326-334.

(Continued)

*Primary Examiner* — Paul S Hyun

(74) *Attorney, Agent, or Firm* — Sara K. M. Hinkley

(57) ABSTRACT

A technique facilitates detection and analysis of constituents, e.g. chemicals, which may be found in formation fluids and/or other types of fluids. The technique comprises intermittently introducing a first fluid and a second fluid into a channel in a manner which forms slugs of the first fluid separated by the second fluid. The intermittent fluids are flowed through the channel to create a mixing action which mixes the fluid in the slugs. The mixing increases the exchange, e.g. transfer, of the chemical constituent between the second fluid and the first fluid. The exchange aids in sensing an amount of the chemical or chemicals for analysis. In many applications, the intermittent introduction, mixing, and measuring can be performed in a subterranean environment.

9 Claims, 3 Drawing Sheets

(52) U.S. Cl.
CPC . *B01L 2200/146* (2013.01); *B01L 2300/0816* (2013.01); *B01L 2300/0867* (2013.01); *B01L 2300/0883* (2013.01); *B01L 2400/0487* (2013.01); *E21B 2049/085* (2013.01)

(56) References Cited

U.S. PATENT DOCUMENTS

| | | | | |
|---|---|---|---|---|
| 7,799,278 | B2 | 9/2010 | Salamitou et al. | |
| 8,708,049 | B2 | 4/2014 | Lawrence et al. | |
| 8,714,254 | B2 | 5/2014 | Harrison et al. | |
| 9,052,289 | B2 | 6/2015 | Lawrence et al. | |
| 2001/0000731 | A1 | 5/2001 | Jia et al. | |
| 2002/0072116 | A1* | 6/2002 | Bhatia | C12M 25/14 435/366 |
| 2006/0003439 | A1* | 1/2006 | Ismagilov | B01F 5/0471 435/287.2 |
| 2006/0213554 | A1* | 9/2006 | Welch | C10L 1/19 137/93 |
| 2009/0107667 | A1 | 4/2009 | Mullins et al. | |
| 2011/0030466 | A1 | 2/2011 | Mostowfi | |
| 2011/0060152 | A1* | 3/2011 | Dennis | B01F 5/0646 554/167 |
| 2012/0276648 | A1 | 11/2012 | van Hal et al. | |

OTHER PUBLICATIONS

A. Gunther, et al. "Transport and reaction in microscale segmented gas-liquid flow," Lab on a Chip, 2004, 4(4), pp. 278-286.

A. Gunther, et al., "Micromixing of Miscible Liquids in Segmented Gas-Liquid Flow," Langmuir, 2005, 21(4), pp. 1547-1555.

G. Bercic, et al, "The role of gas bubbles and liquid slug lengths on mass transport in the Taylor flow through capillaries," Chemical Engineering Science, 1997, 52 (21-22), pp. 3709-3719.

J.R. Burns, et al, "The intensification of rapid reactions in multiphase systems using slug flow in capillaries," Lab on a Chip, 2001, 1(1), pp. 10-15.

M.N. Kashid, et al, "Internal Circulation within the Liquid Slugs of a Liquid-Liquid Slug-Flow Capillary Microreactor," Industrial & Engineering Chemistry Research, 2005, 44(14), pp. 5003-5010.

K. Matsuyama, et al, "Operation of microfluidic liquid slug formation and slug design for kinetics measurement," Chemical Engineering Science, 2007. 62 (18-20), pp. 5133-5136.

S. Roy, et al, "Monoliths as multiphase reactors: A review," AlChE Journal, 2004, 50 (11), pp. 2918-2938.

A.B. Theberge, et al, "Microdroplets in Microfluidics: An Evolving Platform for Discoveries in Chemistry and Biology," Angewandte Chemie International Edition, 2010, 49 (34), pp. 5846-5868.

* cited by examiner

SYSTEM AND METHODOLOGY FOR CHEMICAL CONSTITUENT SENSING AND ANALYSIS

RELATED APPLICATIONS

This application (claims the benefit of a related U.S. Provisional Application Ser. No. 62/067,983) filed Oct. 24, 2014, entitled "SYSTEM AND METHODOLOGY FOR CHEMICAL CONSTITUENT SENSING AND ANALYSIS", to Farshid MOSTOWFI et al., the disclosure of which is incorporated by reference herein in its entirety.

BACKGROUND

The following descriptions and examples are not admitted to be prior art by virtue of their inclusion in this section.

Formation fluid compositions can vary greatly, and understanding such formation fluid compositions can be helpful in assessing well completion and production strategies. A variety of technologies have been employed to facilitate fluid characterization and evaluation of hydrocarbon reserves. For example, various fluid mixing techniques have been used to detect specific chemicals located in the formation fluid. Additionally, various multiphase microreactor techniques, mass transfer techniques, and/or other techniques have been employed in an attempt to better understand formation fluid compositions. However, such technologies have limited usefulness in a variety of environments, including downhole environments.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, a system and methodology are provided to facilitate detection and analysis of constituents, e.g. chemicals, which may be found in formation fluids and/or other types of fluids. The technique comprises introducing a first fluid and a second fluid into a channel in a manner which forms slugs of the first fluid separated by the second fluid. The fluids are flowed through the channel to create a mixing action which mixes the fluid within the slugs. The mixing increases the exchange, e.g. transfer, of the chemical constituent between the second fluid and the first fluid. As a result, the amount of the chemical constituent or constituents can be determined and the fluids may be better analyzed. In many applications, the introduction, mixing, and measuring can be performed in a subterranean environment, e.g. in a wellbore environment.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
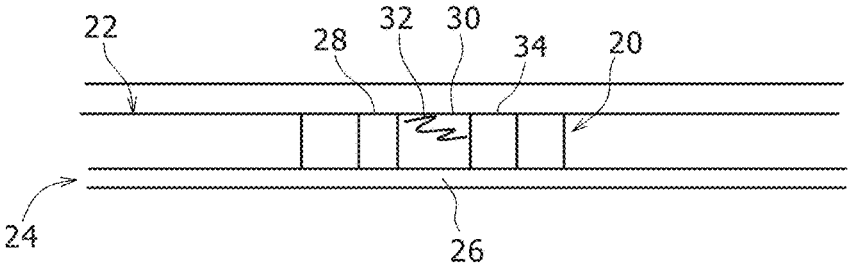
FIG. 1 is a schematic illustration of an example of a fluidic testing system deployed downhole in a well system, according to an embodiment of the disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, a permanent monitoring tool, and a combination tool.

The disclosure herein generally involves a system and methodology which facilitate the sensing and analysis of constituents, e.g. chemicals, which may be found in formation fluids and/or other types of fluids. The technique comprises introducing a first fluid and a second fluid into a channel in a manner which forms slugs of the first fluid separated by the second fluid. Depending on the application, the first fluid and the second fluid may comprise a liquid and a gas, respectively. In other applications, the first and second fluids may comprise two liquids, such as two immiscible liquids.

The intermittent fluids are flowed through the channel to create a mixing action which mixes the slugs of fluid. By way of example, the channel may comprise a capillary which is relatively long and having a comparatively small cross-sectional dimension, e.g. diameter. The mixing may be accomplished by creating a vortex in the slugs, thus increasing the exchange, e.g. transfer, of the chemical constituent between the second fluid and the first fluid. As a result, the chemical constituent or chemical constituents of interest can be sensed/detected for analysis of the fluids, e.g. formation fluids. In many applications, the introduction, mixing, and measuring can be performed in a subterranean environment, e.g. in a wellbore environment. In an embodiment, the system and methodology may be employed for enhanced component mass transfer and equilibration between immiscible fluids via slug flow mixing for downhole fluid analysis.

In general, embodiments described herein are related to a method and system for improving the exchange of components between two fluids. By way of example, the two fluids may comprise a gas and a liquid or two immiscible liquids. Depending on the application, the methodology may be used at a surface location, at a wellsite, at a downhole wellbore location, and/or at a test location subjected to downhole conditions of high temperature and high pressure. The embodiments improve the exchange between the two fluids by increasing a surface area between the two fluids which makes the methodology very effective for compound/constituent extraction.

According to an embodiment, a fluidic test system is provided with a narrow channel, e.g. capillary, having an inside diameter equal to or less than 500 μm and sometimes equal to or less than 200 μm. The narrow channel is relatively long and may be up to 1 m or more in length. In this example, the channel is arranged in a serpentine path on a substrate which may be part of a microfluidic chip. The two fluids are introduced into the channel in such a way as to flow as short slugs through the channel. Flow through the channel mixes the liquid in the slugs by creating, for example, a vortex within the liquid slugs. This mixing increases the exchange between the two fluids. As a result, an improved efficiency and a reduced operation time are enabled with respect to completion of component mixing between the two fluids. This allows downhole operations that involve chemical reaction, compound stripping, and fluid property manipulation to be enhanced for improved chemical sensing and analysis.

Chemical sensing and analysis often are helpful for downhole fluid characterization and, ultimately, in the evaluation of hydrocarbon reserves. Understanding wellbore fluid compositions, including concentration levels of corrosion causing compounds/constituents such as $CO_2$ and $H_2S$, can be very helpful in assessing eventual well completion and production strategies. In some embodiments, the present technique enables the sensing and analysis of such fluids and fluid constituents to be carried out on a well string deployed downhole in a wellbore as opposed to a conventional approach of sending samples to a laboratory where they are reconstituted to reservoir conditions and then analyzed.

A variety of analytical methods, including colorimetric methods, can be used to facilitate analysis of certain constituents in reservoir fluids. Many of these analytical methods utilize interaction between a reagent (such as a water-based liquid for example) and a sample fluid. By way of example, such methods may include a methylene blue method and/or other methods using the reaction of metal ions with sulfide irons to form metal sulfide. Such methods utilize transfer of hydrogen sulfide from the gas or oil phase to the water phase. The present system and methodology may be used to facilitate a variety of these analytical methods by enhancing mass transfer between immiscible fluids without forming an emulsion.

As described herein, the flowing of intermittent fluids along a relatively long channel, e.g. microchannel, is highly efficient in increasing a mass transfer rate between the fluids, e.g. between a gas phase and a liquid phase. The high mass transfer rate is achieved by establishing a high surface-to-volume ratio in the channel combined with a short diffusion length of, for example, gas through the liquid. The short diffusion length can be obtained by operating the channel in a two-phase slug flow regime, sometimes referred to as a Taylor flow regime. In some applications, the slug flow is characterized by a train of liquid slugs and gas bubbles moving consecutively through the channel. The gas bubble length tends to be several times longer than the diameter of the channel, and the gas bubble diameter is almost equal to the channel diameter. Generally, a thin liquid film separates the gas bubble from the inside wall surface of the channel.

In some embodiments, the intensification of the mixing process also can be achieved in a liquid-liquid slug flow of two immiscible liquids. In liquid-liquid slug flow, the internal circulation in the liquid slugs substantially enhances the mass transfer at the interface between the two liquids. Thus, by flowing the intermittent slugs of immiscible liquids through the channel, the mass transfer rate between the immiscible fluids can be substantially increased. Embodiments described herein can be used to enhance component mass transfer between two otherwise immiscible fluids. However, the system and methodology also can be used to mix two or more miscible fluids with the aid of an immiscible fluid.

Referring generally to FIG. 1, an example of a fluidic testing system 20 is illustrated. In this embodiment, the fluidic testing system 20 is positioned along a well string 22 disposed in a wellbore 24 such that the fluidic testing system 20 is at a desired subterranean, e.g. downhole, location 26. By way of example, the fluidic test system 20 may comprise an injection system 28 which introduces at least a first fluid and a second fluid into a mixing system 30, in which at least one fluid is intermittent. The mixing system 30 has a channel structure 32, e.g. a capillary structure, which may be arranged in a serpentine pattern or other suitable pattern. The fluid test system 20 further comprises a measurement system 34 which may be used to determine the rate or amount of mass transfer with respect to a given chemical constituent. For example, the measurement system 34 may be used to measure an amount of a chemical constituent transferred from the second fluid to the first fluid during the mixing process which occurs as the fluids flow along channel 32. In some applications, the measurement system 34 comprises an optical measurement system as discussed above.

Two-phase flow in conduits, e.g. capillaries, may be referred to as slug flow and this type of two-phase flow has applications in monolith reactors and micro-mixing devices. Slug flows in channels, e.g. microchannels, provide thorough mixing and excellent heat transfer properties. However, mixing two liquid phases in a microchannel can be a challenging task due to a low Reynolds number associated with the liquid flow. However, by injecting gas bubbles intermittently inside the channel 32, the two liquids can be mixed efficiently. The fluidic testing system 20 may be used to enable this efficient mixing of fluids to enhance mass transfer of a given chemical constituent between fluids.

Figure 2:
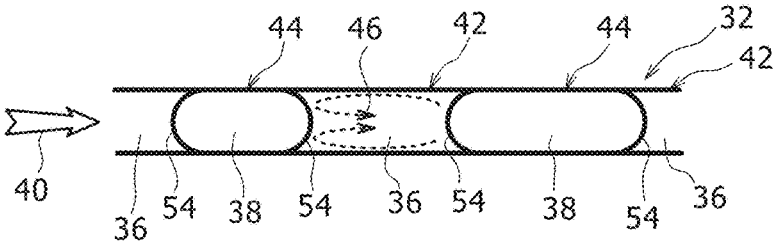
FIG. 2 is a schematic illustration of an example of a channel through which slugs of a first fluid are flowed while separated by a second fluid, according to an embodiment of the disclosure.

Referring generally to FIG. 2, a schematic illustration of channel 32 is illustrated in the form of a microchannel. At least one of a first fluid 36 and a second fluid 38 are intermittently introduced into the channel 32 and flowed along the channel 32 in the direction indicated by arrow 40. In this example, the first fluid 36 may be a liquid and the second fluid 38 may be a gas such that the first fluid 36 forms slugs 42 separated by the second fluid 38 which forms bubbles 44 between the slugs 42. In this example, the size of the bubbles 44 increases along the channel 32 due to a gradual pressure drop. This increase in bubble size leads to an increase in void fraction, which is defined as the volume of gas over the total volume ($V_g/V_{total}$).

Figure 3:
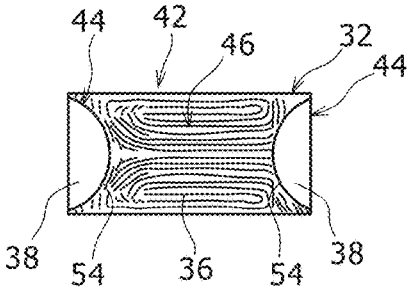
FIG. 3 is a schematic illustration of an example of a slug of the first fluid undergoing a mixing action by creating, for example, a vortex, according to an embodiment of the disclosure.
Figure 4:
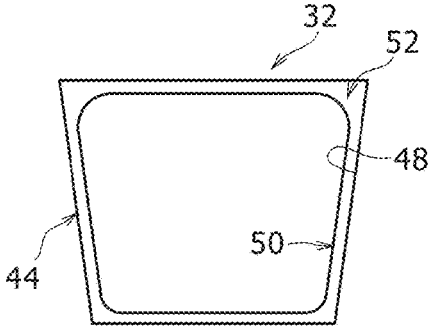
FIG. 4 is a cross-sectional view of an example of a channel for fluid flow, according to an embodiment of the disclosure.

In this example, the increase in void fraction causes a gradual increase in the fluid velocity along channel 32. However, even though there is a gradual change in velocity and void fraction along the channel 32, the mean-pressure-gradient along the channel 32 tends to remain constant. The movement through channel 32 creates a mixing action, e.g. a vortex 46, in the slugs 42, as illustrated in FIG. 3. Additionally, the liquid phase in the form of first fluid 36 wets an inside surface 48 of channel 32, as illustrated in FIG. 4. In other words, a thin liquid film 50 is trapped between the gas phase of second fluid 38 and the solid inside surface 48. The thickness of the liquid film 50 may be non-uniform. For example, if the cross-sectional configuration of channel 32 has four sides, e.g. rectangular or trapezoidal, the film thickness may be non-uniform and have thicker regions 52.

However, the thickness of the liquid film 50 can be estimated for a suitable engineering analysis by an accurate semi-spherical equation for flow through a circular channel by the following equation:

$$\frac{\delta}{R_c} = \frac{1.32Ca^{2/3}}{1 + 3.33Ca^{\frac{2}{3}}}$$

where $\delta$ is the film thickness, $R_C$ is the channel hydraulic radius, and $C_a$ is the capillary number. The capillary number is defined as the ratio of the viscous and interfacial forces ($Ca=\mu_L U_B/\gamma$ where $\mu_L$, $U_B$, and $\gamma$ are liquid viscosity, bubble velocity, and gas-liquid interfacial tension, respectively.

In FIG. 2, the end caps 54 of the bubbles 44 are illustrated as semi-spherical which is how the bubbles 44 exist when stationary in a circular channel/capillary 32. When the bubbles travel along the channel 32, the end caps 54 deform slightly and the front end caps become slightly narrow and conically shaped while the rear end caps are generally flat. If four-sided channels 32 are employed, e.g. see the embodiment of FIG. 4, the end caps 54 can deviate substantially from the semi-spherical shape.

Substantial mass and heat transfer during the flow of slugs 42 is facilitated by employing relatively small channel cross-sections, low-intensity slug vortices 46, high shear in the thin liquid film 50, and a suitable cross-sectional shape, such as a four-sided cross-section. By way of example, a rectangular cross-sectional shape is suitable in many applications. The time for diffusion driven processes correlates with the square of the length of the channel 32. Therefore, the channel 32 is constructed with a maximum cross-sectional dimension, e.g. diameter, which is small relative to the length of the channel 32. By way of example, the length of the channel 32 may range from a few centimeters to a meter or more.

In many applications, the channel 32 is in the form of a microchannel having a maximum cross-sectional dimension equal to or less than 500 μm, and in some applications equal to or less than 200 μm, and in some applications equal to or less than 100 μm. Such construction of the channel 32 can improve the diffusion time substantially, e.g. by a factor of $10^6$. Additionally, high shear flow in the liquid film 50 and the powerful vortices 46 in the slugs 42 provide an intensive interphase mass transfer by convection. The bubbles 44 are engulfed in liquid, thus further facilitating an effective mass and heat transfer. The recirculating or mixing regions, e.g. vortices 46, in the liquid slugs 42 further ensure effective mixing inside the liquid slugs 42.

Figure 5:
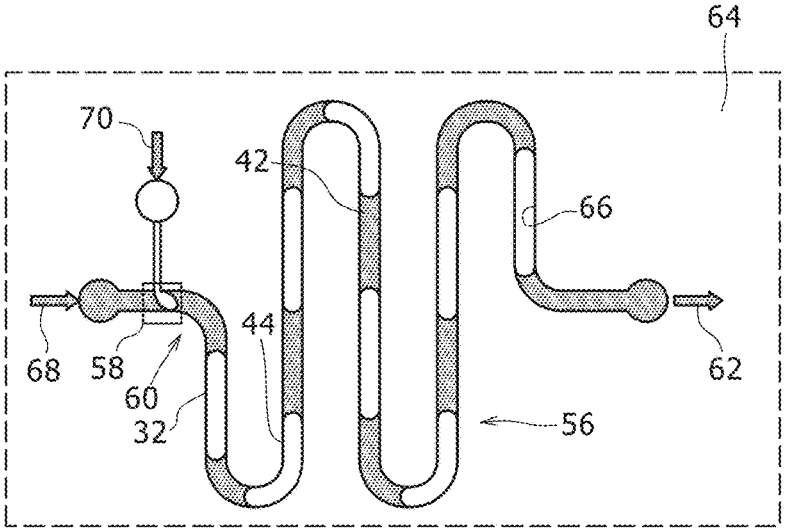
FIG. 5 is a schematic illustration of an example of a serpentine channel having slugs of a first fluid separated by a second fluid, according to an embodiment of the disclosure.

Referring generally to FIG. 5, an embodiment of channel 32 is illustrated as an example of a construction which substantially enhances mixing of concurrently flowing liquid and gas phases in the microfluidic system 20 while at high pressure and temperature. In this example, the channel 32 is in the form of a narrow capillary or microchannel which has a serpentine shape 56 such that the flow of first fluid 36 and second fluid 38 moves along a path which reverses in direction. In this example, the first fluid 36 is a liquid and the second fluid 38 is a gas. The liquid phase 36 and the gas phase 38 are brought into contact with each other at a junction 58, such as a T-junction, to develop the desired slug flow between an inlet 60 of channel 32 and an exit 62.

As described above, the slug flow along channel 32 provides enhanced mass transfer characteristics and substantially increased mixing. The improved mixing in the channel 32 is used to facilitate mass transfer between fluids, e.g. between $H_2S$ gas and a chemical reagent. The concentration of the $H_2S$ (or other chemical constituent of interest) is determined in the reagent before and after the mixing to establish effectiveness of slug flow mixing. The microfluidic mixing and testing system 20 is readily constructed to withstand downhole conditions which renders the slug flow mixing methodology described herein feasible for downhole measurement of specific chemical constituents, such as $H_2S$, $CO_2$, or other gases.

By way of example, channel 32 may be positioned on or in a variety of substrates 64. In the illustrated embodiment, the serpentine microchannel structure of channel 32 is etched into substrate 64 such that the substrate itself forms the channel structure. By way of example, the channel 32 may be etched in a silicon substrate 64. However, the channel 32 also may be made of polyetheretherketone (PEEK) and/or other materials suitable for use in downhole applications or other oil industry applications. In this example, the channel 32 again has a small diameter, e.g. less than 200 μm, and the length ranges from a few centimeters to at least a meter. The substrate 64 containing the channel 32, e.g. serpentine structure 56, may be bonded to glass, to another silicon substrate, or to another suitable substrate so as to form a closed microfluidic device, e.g. microfluidic chip, that may be mounted on, in, and/or along well string 22.

Due to the micron scale dimensions of the channel 32, the sample volume used in the fluid system 20 may be on the order of a few microliters. In some applications, the inside surface 48 of channel 32 may comprise a coating 66 formed of appropriate chemicals, polymers, or other materials to make channel 32 less sensitive to scavenging or corrosion. Various coatings 66 also may be used to change the wetting properties of the channel 32, e.g. to change the hydrophilic or hydrophobic properties of the channel 32.

In the embodiment illustrated in FIG. 5, the microfluidic system 20 has two ports 68, 70 at inlet 60. By way of example, the ports 68, 70 may comprise a liquid inlet port and a gas inlet port, respectively. Sample fluids and chemical reagents are injected into channel 32 via the inlet ports 68, 70 which can be appropriately designed for liquid and/or gas flow according to the parameters of a given application. In some applications, the number of inlet ports can be increased to facilitate injection of multiple reagents in sequence or in other desired patterns. In a simple example, a sample fluid and a reagent flow through the inlet ports 68, 70 and come into contact at T-junction 58. The T-junction 58 is constructed to have two flow paths which intercept each other at a desired angle, e.g. at a perpendicular angle which is effective for establishing the slug flow.

The formation of slug flow is readily controlled at the T-junction 58, however other designs may be used to introduce the first and second fluids in such a way as to initiate the slug flow. In the case shown, the gas inlet port 70 may be intermittently introduced into a more continuous flow of liquid from the liquid inlet port 68. In some other cases, the reverse may be true, the liquid may be intermittently introduced into a more continuous flow of gas. In still other cases, the two fluids may both be substantially continuous and the resulting combination formed into slugs due to the configuration and degree of cohesiveness or immiscibility of the fluids.

The volumetric flow rate of the test fluids is controlled so as to develop segmented flow where the fluids are distributed in the channel as discrete segments, e.g. slugs, of a first fluid separated by a second fluid. In the case of liquid and gas flow, the liquid flow rate can be controlled to effectively snap-off gas bubbles at the junction 58, thus producing slug flow.

Figure 6:
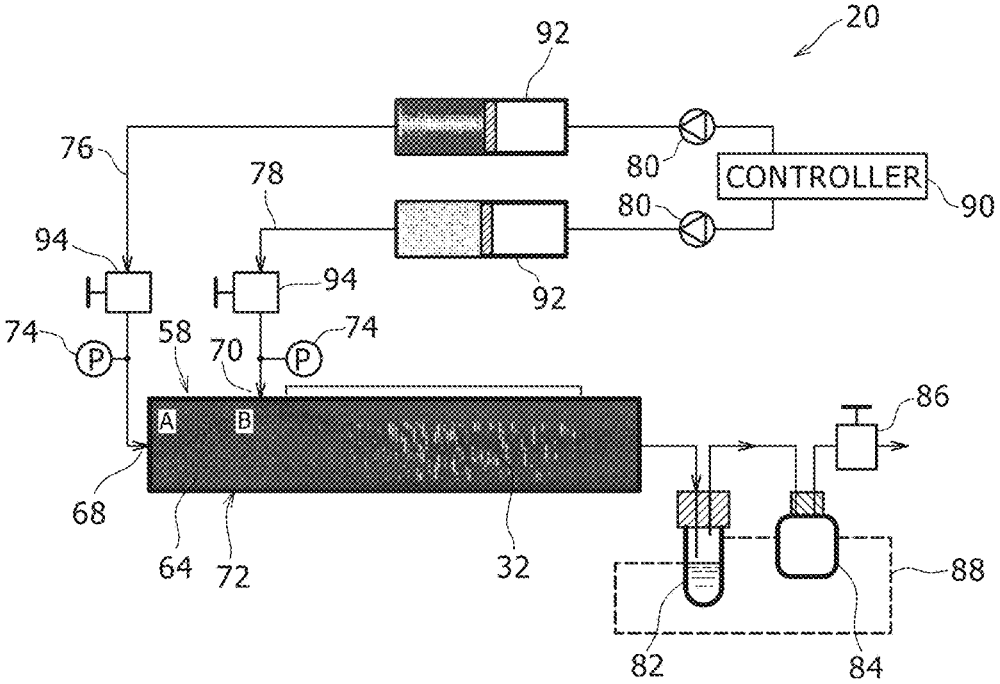
FIG. 6 is a schematic illustration of an example of a fluidic sensing and analysis system, according to an embodiment of the disclosure.

Referring generally to FIG. 6, a schematic illustration is provided of an embodiment of fluidic system 20. In this example, system 20 is a microfluidic system used to evaluate the efficiency of a mixing process in a gas-liquid slug flow. The microfluidic system 20 comprises a microfluidic device 72 which includes substrate 64 and channel 32. Channel 32 may be in the form of serpentine construction 56. Liquid and gas phases are injected into channel 32 through ports 68 and 70, respectively. To develop the slug flow, the gas can be injected at a constant flow rate through port 70 and the liquid flow rate can be gradually increased until well-defined slugs and bubbles are established in the channel 32.

In this example, pressure sensors 74 are placed in a liquid flow line 76 and a gas flow line 78 used to deliver the liquid and gas phases to channel 32 via ports 68, 70, respectively. The pressure sensors 74 may be employed to monitor pressure at the inlets 68, 70 of channel 32. The volumetric ratio of the gas and liquid flow rates may be regulated by pumps 80, such as computer-controlled positive displacement pumps. The gas-liquid slug flow at the end of channel 32 can be separated into liquid and gas via, for example, a liquid trap 82 and a gas collection device 84, respectively. The separated phases may be passed through a suitable valve or valves 86 for further analysis.

However, the separated liquid and gas phases collected at the exit end of the channel 32 become well mixed during passage along channel 32 and can be analyzed in situ by a suitable measurement system 88, such as an optical measurement system. The measurement system 88 may be used to interrogate the output streams and to obtain, for example, the constituent concentration or other characteristics of the sample fluid. For example, the measurement system 88 may be used to determine the amount of the chemical constituent of interest, e.g. $H_2S$, transferred from the second fluid/gas to the first fluid/liquid.

It should be noted that fluidic system 20 may comprise a variety of other and/or additional components depending on the system construction and the environment in which fluidic system 20 is employed. For example, fluidic system 20 may be constructed for use in high pressure and high temperature environments, such as downhole environments. However, the system 20 also may be used in various other environments, including surface environments. In the specific embodiment illustrated in FIG. 6, examples of additional components comprise a controller 90 for controlling pumps 80. In this example, the pumps 80 deliver the fluids from fluid sources 92, such as a liquid source and a gas source, and through flowlines 76, 78 to channel 32. Various valves 94 may be positioned along flowlines 76, 78 to control the flow of fluid along flow control line 76, 78. Additionally, various other and/or additional components may be incorporated into the overall system.

In an operational example, the fluidic testing system 20 was used in mixing first fluid 36 in the form of a liquid reagent with second fluid 38 in the form of $H_2S$ gas. The liquid phase/reagent 36 injected into the channel 32 was formed of 2 mM $Bi(NO_3)_2$ in 1.75% poly (acrylic acid) in water which indicates absorption of the hydrogen sulfide ($H_2S$) gas 38 in the liquid phase 36 by changing color. The $H_2S$ sample was prepared by mixing 5 ppm $H_2S$ in nitrogen ($N_2$) as the balancing gas. The ratio of the volumetric flow rates of the gas 38 and the liquid 36 is maintained at 5:1 during the microfluidic testing. The pressure at the inlet 60 of channel 32 was maintained at 500 psi. As described above, the gas 38 and the liquid 36 traveled along channel 32 in slug flow condition. The gas phase and the liquid phase discharged through exit 62 were then gravimetrically separated and analyzed via measurement system 88.

It should be noted the measurement system 88 may vary depending on the application. By way of example, the measurement system 88 may comprise a spectrometer for analyzing the liquid and a colorimetric detector for analyzing the gas. In the specific example discussed above, the $H_2S$ served as the transport component and basis for assessing equilibration/mass transfer efficiency. In this example, the liquid phase/reagent 36 was analyzed before and after the slug flow mixing. As referenced above, the analysis of the liquid phase 36 may be performed on a spectrometer, such as a UV-VIS-NIR (e.g. a Cary 5000 spectrometer) while analysis of the gas phase 38 may be performed on a dry colorimetric sulfur detector (e.g. a C.I. Analytics 2010L).

In a variety of operational applications, the measurement system 88 may comprise suitable spectrometer and detector components mounted into the fluidic testing system 20 at a downhole location 26 in wellbore 24. However, a variety of other components and techniques may be used to perform interrogation methods for assessing equilibration. Examples of other interrogation methods include fluorescence measurement, electrochemical measurement, NMR or viscosity measurement, and/or other suitable measurement techniques. In some applications, the fluidic testing system 20 also may be configured to separate two immiscible fluids by using a membrane/filter or centrifugal separation. By way of further example, the separation system also may comprise a capillary array that is integrated into, for example, a microfluidic chip which may be located in a downhole environment.

Figure 7:
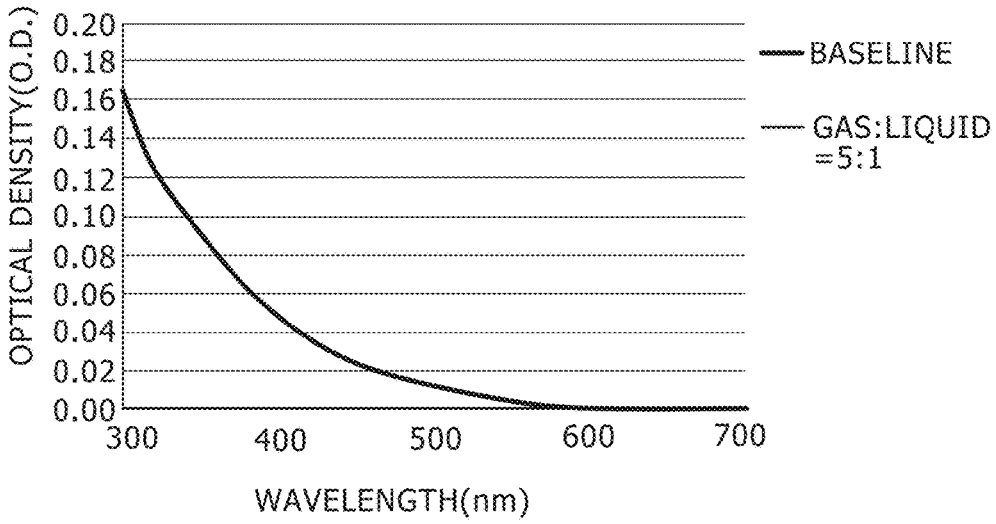
FIG. 7 is a graphical representation of an example of measurement of a chemical constituent following microfluidic slug flow mixing, according to an embodiment of the disclosure.

In this example, the optical density (in the 300-700 nm range) measured in the reagent 36 after the slug flow mixing along channel 32 is illustrated graphically in FIG. 7. The optical density of the reagent 36 prior to slug flow mixing was considered as the baseline (zero $H_2S$). The concentration of $H_2S$ in the gas phase 38, after slug flow mixing along channel 32, was measured to be zero. A corresponding spectral analysis of the liquid phase 36 collected from the slug flow after exiting channel 32 shows an increase in optical density which corresponds to an $H_2S$ concentration of 0.05 mM. Such results indicate a highly efficient component mass transfer of the $H_2S$ constituent between the gas phase 38 and the liquid phase 36 is a result of the mixing which occurred during the slug flow through channel 32.

Similar to the microfluidic techniques described above, another embodiment involves a minifluidic approach which uses channel 32 in the form of a tube having a small inner diameter, e.g. less than 300 μm. The tube/channel 32 may be at least 10 cm long and can have a length up to at least 10 m. In some applications, the tube 32 may be formed as a stainless steel column that can be used in high pressure and high temperature environments. The interior of the tube 32 may be covered with a suitable coating 66 which makes the tube less sensitive to scavenging and/or corrosion. The coating 66 also may be selected to adjust tube properties, e.g. to make the tube more hydrophilic or hydrophobic. As with the previously described embodiments, the measurement system 88 can utilize a variety of interrogation methods including, for example, optical interrogation, fluorescence measurement, electrochemical measurement, NMR or viscosity measurement, an/or other suitable measurements. The fluidic testing system 20 again may be configured facilitate separation of two immiscible fluids using, for example, a membrane, a filter, and/or a gravitational separation.

The minifluidic set-up may be very similar to the microfluidic system illustrated in FIG. 6. In the minifluidic embodiment, the microfluidic device 72 is replaced by the tube/channel 32. In a specific example, a maximum, inner cross-sectional dimension of the tube, e.g. inner diameter of the tube, is less than 500 μm and sometimes less than 300 μm and the tube has a length of about 2 m although other lengths may be used in other applications. The tube/channel should be configured so that laminar flow is created therein. By way of specific example, a back pressure regulator can be used to maintain the system at approximately 500 psi (or another suitable pressure) and the liquid phase 36 is collected after the back pressure regulator. In this example, the flow rate of the reagent/liquid phase 36 is on the order of 5 ml/minute and the flow rate of the gas is either a 2:1 or a 5:1 gas to reagent ratio for 50 ppm $H_2S$ gas.

Figure 8:
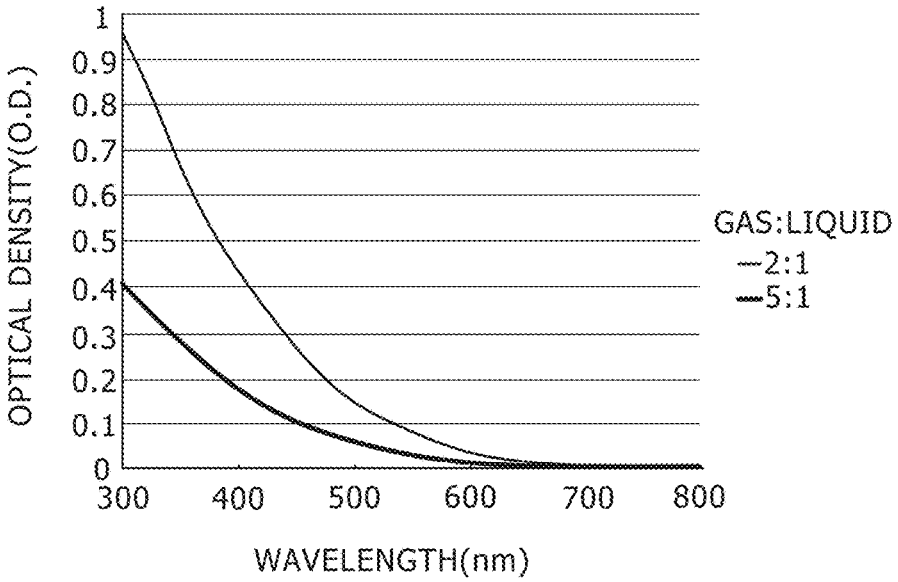
FIG. 8 is a graphical representation of another example of measurement of a chemical constituent following slug mixing, according to an embodiment of the disclosure.

Referring generally to FIG. 8, a graphical representation is provided of the absorption curves of the reacted reagent for the specific example. The ratio between the two absorbance values is illustrated as close to a ratio of 1:2.5. The measured optical intensities are about 15% lower than would otherwise be expected based on the sodium sulfide experiments being performed at room temperature. The lower intensity is accounted for by the difference in mixing methods. For example, bismuth sulfide particles formed by mixing via slug flow are smaller than those formed from the sodium sulfide analyses. As a result, there is a blue shift of the absorbance curve and thus a slightly lower intensity.

However, the results demonstrate the enhanced mass transfer between the gas phase 38 and the liquid phase 36 during slug flow along channel 32. This enhanced mixing facilitates many hydrocarbon related sensing and analysis applications in which specific constituents are detected and evaluated based on the mass transfer of those constituents between two fluids.

Depending on the specifics of a given chemical constituent sensing and analysis application, the components of fluidic system 20 may be adjusted and/or changed. For example, various fluid injection systems and constituent measurement systems may be employed. Additionally, the configuration of the channel 32 may be selected according to the environment in which it is used and according to the parameters of a given application. The channel 32 may have a variety of cross-sectional shapes and sizes as well as a variety of lengths to accommodate testing for various constituents in many types of environments. In some applications, the channel 32 may be generally circular in cross-section while other applications may utilize cross-sectional configurations having multiple sides. For example, the channel may be defined by four sides arranged in a generally rectangular/trapezoidal pattern. The fluidic system 20 also may be constructed for testing and analyzing numerous types of fluids, e.g. hydrocarbon-based fluids, having a variety of chemical constituents which may be detected via the slug flow processes described above.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method of chemical sensing and analysis, comprising:

introducing a first fluid as a liquid with an extraction reagent and a second fluid as a gas with a sample fluid independently into a channel to form slugs of the first fluid separated by the second fluid;

creating a vortex in the slugs by moving the first fluid and the second fluid along the channel to increase an exchange of a chemical constituent between the second fluid and the first fluid;

detecting the amount of the chemical constituent transferred from the second fluid to the first fluid, wherein the second fluid initially contains the chemical constituent.

2. The method as recited in claim 1, wherein introducing comprises intermittently introducing the first fluid or the second fluid into the channel.

3. The method as recited in claim 1, wherein the chemical constituent is H2S.

4. The method as recited in claim 1, further comprising effectively increasing a flow velocity of the first fluid and the second fluid as they flow through the channel.

5. The method as recited in claim 1, further comprising forming the channel as a serpentine capillary in a silicon substrate.

6. The method as recited in claim 1, further comprising forming the channel such that laminar flow is created in the channel.

7. The method as recited in claim 1, further comprising forming the channel such that the channel has a cross-section defined by four sides.

8. The method as recited in claim 1, wherein detecting comprises using an optical measurement system to detect the amount of the chemical constituent exchange between the second fluid and the first fluid.

9. A method of chemical sensing and analysis, comprising:

introducing a first fluid with an extraction reagent and a second fluid with a sample fluid independently into a channel to form slugs of the first fluid separated by the second fluid;

creating a vortex in the slugs by moving the first fluid and the second fluid along the channel to increase an exchange of a chemical constituent between the second fluid and the first fluid;

detecting the amount of the chemical constituent transferred from the second fluid to the first fluid, wherein the chemical constituent is H2S.

* * * * *